US009818349B2

(12) United States Patent
Won et al.

(10) Patent No.: US 9,818,349 B2
(45) Date of Patent: Nov. 14, 2017

(54) DISPLAY APPARATUS AND METHOD OF DISPLAYING AN IMAGE USING THE SAME

(71) Applicant: Samsung Display Co., LTD., Yongin, Gyeonggi-Do (KR)

(72) Inventors: Byeong-Hee Won, Hwaseong-si (KR); Rang-Kyun Mok, Seoul (KR); Jong-In Baek, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 218 days.

(21) Appl. No.: 14/271,736

(22) Filed: May 7, 2014

(65) Prior Publication Data

US 2015/0145895 A1 May 28, 2015

(30) Foreign Application Priority Data

Nov. 27, 2013 (KR) ..... 10-2013-0145381

(51) Int. Cl.

| | |
|---|---|
| ***G09G 5/10*** | (2006.01) |
| ***G09G 3/36*** | (2006.01) |
| ***G09G 3/34*** | (2006.01) |
| *G09G 3/20* | (2006.01) |

(52) U.S. Cl.

CPC ..... *G09G 3/36* (2013.01); *G09G 3/3406* (2013.01); *G09G 3/2003* (2013.01); *G09G 2320/0646* (2013.01); *G09G 2320/0666* (2013.01); *G09G 2380/08* (2013.01)

(58) Field of Classification Search

None

See application file for complete search history.

(56) References Cited

U.S. PATENT DOCUMENTS

| | | | | |
|---|---|---|---|---|
| 8,240,901 | B2 | 8/2012 | Overes et al. | |
| 8,371,733 | B2 | 2/2013 | Hoogenstraaten et al. | |
| 2002/0024529 | A1* | 2/2002 | Miller | G09G 5/10 345/690 |
| 2002/0153472 | A1* | 10/2002 | Yano | H04N 9/73 250/208.1 |
| 2009/0225065 | A1* | 9/2009 | Overes | H05B 37/0218 345/207 |
| 2009/0281604 | A1* | 11/2009 | De Boer | A61M 21/00 607/88 |

(Continued)

FOREIGN PATENT DOCUMENTS

| | | | |
|---|---|---|---|
| KR | 1020060123439 | A | 12/2006 |
| KR | 1020130049895 | A | 5/2013 |

*Primary Examiner* — Christopher R Lamb

(74) *Attorney, Agent, or Firm* — Cantor Colburn LLP

(57) ABSTRACT

A display apparatus includes a display panel, an illumination part, an illumination controller, a luminance compensation part and a data driver. The display panel includes data lines, and is configured to display an image in a first direction. The illumination part is configured to emit illumination light having a first color in a second direction opposite to the first direction. The illumination controller is configured to control the illumination part and output an illumination signal corresponding to an intensity of the illumination light. The luminance compensation part is configured to compensate luminance of an input image data based on the illumination signal to output a data signal, and the data driver is configured to generate a data voltage based on the data signal, and output the data voltage to the data lines.

18 Claims, 6 Drawing Sheets

(56) References Cited

U.S. PATENT DOCUMENTS

| | | | | |
|---|---|---|---|---|
| 2010/0052548 | A1* | 3/2010 | Allard | G09G 3/3413 315/154 |
| 2010/0053136 | A1* | 3/2010 | Ohta | G09G 3/3413 345/211 |
| 2010/0054136 | A1* | 3/2010 | Mehta | H04N 7/17318 370/245 |
| 2011/0194274 | A1 | 8/2011 | Kwisthout et al. | |
| 2012/0069551 | A1* | 3/2012 | Bues | G02F 1/133603 362/97.2 |
| 2014/0210802 | A1* | 7/2014 | Myers | G09G 3/3413 345/207 |

* cited by examiner

DISPLAY APPARATUS AND METHOD OF DISPLAYING AN IMAGE USING THE SAME

This application claims priority to Korean Patent Application No. 10-2013-0145381, filed on Nov. 27, 2013, and all the benefits accruing therefrom under 35 U.S.C. §119, the content of which is herein incorporated by reference in its entireties.

BACKGROUND

1. Field

Exemplary embodiments of the invention relate to a display apparatus and method of displaying an image using the display apparatus. More particularly, exemplary embodiments of the invention relate to a display apparatus including an illumination part which illuminates an external background of the display apparatus and a method of displaying an image using the display apparatus.

2. Description of the Related Art

Generally, a liquid crystal display apparatus includes a liquid crystal display panel for displaying an image and includes a light source module for providing light to the liquid crystal display panel. For example, the light source module may be a backlight assembly.

The liquid crystal display panel may include a set of pixel electrodes, a common electrode, and a liquid crystal layer disposed between the set of pixel electrodes and the common electrode. In the liquid crystal display panel, voltages may be applied to the pixel electrodes and the common electrode to generate an electric field. When the electric field is adjusted, the light transmittance of the liquid crystal layer is adjusted so that a desired image is displayed. The image is displayed by red, green and blue light.

A serotonin is produced in the human body during day time, and converted to a melatonin during night time. The melatonin induces sleep. When a viewer watches a blue colored light in a specific wavelength range for a long time, the melatonin production is suppressed, such that sleep induction in the viewer may be disturbed.

SUMMARY

One or more exemplary embodiment of the invention provides a display apparatus including an illumination part which illuminates an external background of the display apparatus.

One or more exemplary embodiment of the invention also provides a method of displaying an image using the display apparatus.

According to an exemplary embodiment, a display apparatus includes a display panel, an illumination part, an illumination controller, a luminance compensation part and a data driver. The display panel includes data lines, and is configured to display an image in a first direction. The illumination part is configured to emit illumination light having a first color in a second direction opposite to the first direction. The illumination controller is configured to control the illumination part and output an illumination signal corresponding to an intensity of the illumination light. The luminance compensation part is configured to compensate luminance of an input image data based on the illumination signal to output a data signal, and the data driver is configured to generate a data voltage based on the data signal, and output the data voltage to the data lines.

In an exemplary embodiment, the input image data may include red image data, green image data and blue image data. The luminance compensation part may decrease luminance of the blue image data based on the illumination signal.

In an exemplary embodiment, the luminance compensation part may include a first look-up table including values of a luminance decrease rate of the blue image data corresponding to the illumination signal.

In an exemplary embodiment, the input image data may include red image data, green image data and blue image data. The luminance compensation part may decrease luminance of the blue image data and the green image data, and increases luminance of the red image data, based on the illumination signal.

In an exemplary embodiment, the luminance compensation part may include a first look-up table, a second look-up table and a third look-up table. The first look-up table may include values of a luminance decrease rate of the blue image data corresponding to the illumination signal, the second look-up table may include values of a luminance decrease rate of the green image data corresponding to the illumination signal, and the third look-up table may include values of a luminance increase rate of the red image data corresponding to the illumination signal.

In an exemplary embodiment, a luminance decrease rate of the blue image data may correspond to a grayscale level of the blue image data, a luminance decrease rate of the green image data may correspond to a grayscale level of the green image data, and a luminance increase rate of the red image data may correspond to a grayscale level of the red image data.

In an exemplary embodiment, the intensity of the illumination light in a wavelength range of 500 nanometers (nm) to 800 nm may be greater than the intensity of the illumination light in a wavelength range of 380 nm to 500 nm.

In an exemplary embodiment, the intensity of the illumination light at a wavelength in the wavelength range of 500 nm to 800 nm may increase, as the wavelength increases.

In an exemplary embodiment, the illumination part may include a light source which is configured to generate the illumination light. The illumination controller outputs the illumination signal based on the number of the light source in a turn-on state.

In an exemplary embodiment, the display apparatus may further include a backlight assembly which is configured to provide light to the display panel. The illumination part may emit the illumination light using the light emitted by the backlight assembly, and, the illumination signal corresponds to an intensity of the light emitted by the backlight assembly.

In an exemplary embodiment, the display apparatus may further include a light guide part which is configured to guide the light emitted by the backlight assembly to the illumination part. The illumination part may include an optical film which is configured to convert the light emitted by the backlight assembly into the illumination light.

In an exemplary embodiment, the display apparatus may further include a bezel which covers outer edges of the display panel. The bezel may include a transparent material.

According to an exemplary embodiment, a method of displaying an image using a display apparatus includes emitting illumination light having a first color from a second surface of the display apparatus to an external background, outputting an illumination signal corresponding to an intensity of the illumination light, and compensating luminance of an input image data based on the illumination signal. The second surface is opposite to a first surface of the display apparatus on which the image is displayed.

In an exemplary embodiment, the input image data may include red image data, green image data and blue image data. The compensating the luminance of the input image data may include decreasing luminance of the blue image data based on the illumination signal.

In an exemplary embodiment, the intensity of the illumination light in a wavelength range of 500 nm to 800 nm may be greater than the intensity of the illumination light in a wavelength range of 380 nm to 500 nm. The intensity of the illumination light at a wavelength in the wavelength range of 500 nm to 800 nm may increase, as the wavelength increases.

In an exemplary embodiment, the compensating the luminance of the input image data may include decreasing luminance of the green image data based on the illumination signal, and increasing luminance of the red image data based on the illumination signal.

In an exemplary embodiment, the emitting the illumination light having the first color may include using an illumination part, where the illumination part may include a light source which is configured to generate the illumination light.

In an exemplary embodiment, the emitting the illumination light having the first color may include using an illumination part which emits the illumination light using light emitted by a backlight assembly of the display apparatus, where the backlight assembly is configured to provide the light to a display panel.

According to one or more exemplary embodiment of the display apparatus and the method of displaying an image using the display apparatus, effects of melatonin suppression and power consumption are decreased.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
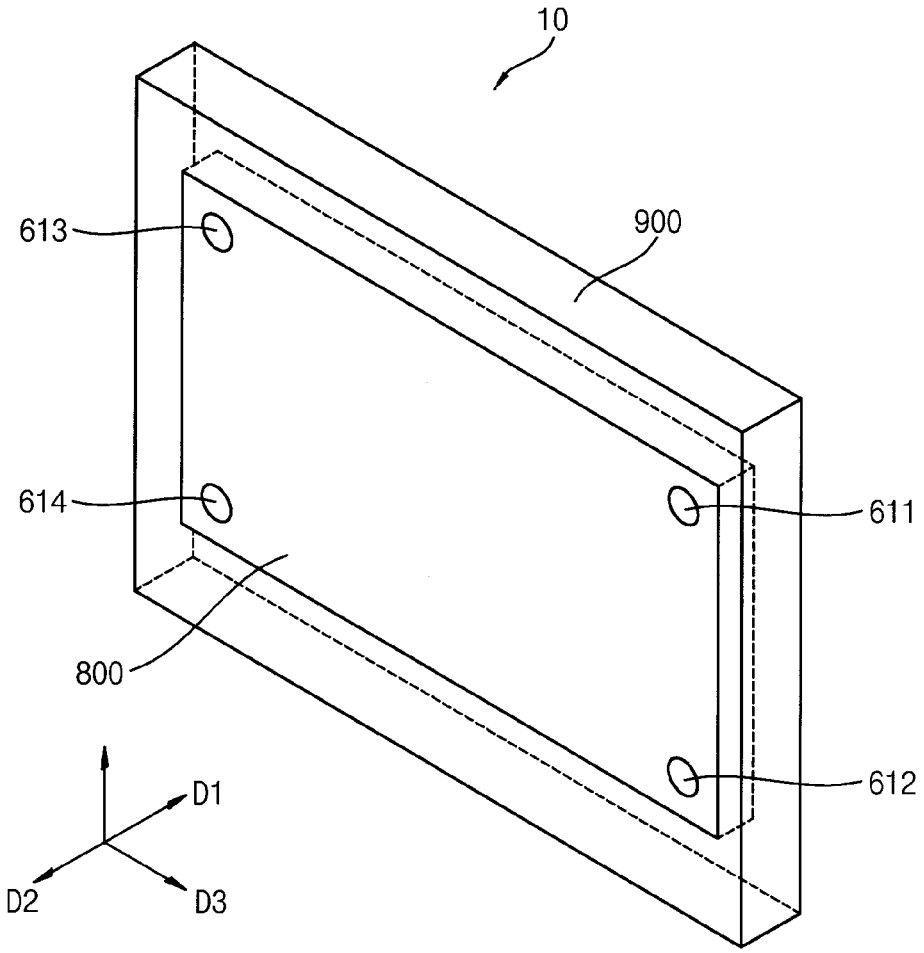
FIG. 1 is a perspective view illustrating an exemplary embodiment of a display apparatus in accordance with the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

Figure 2:
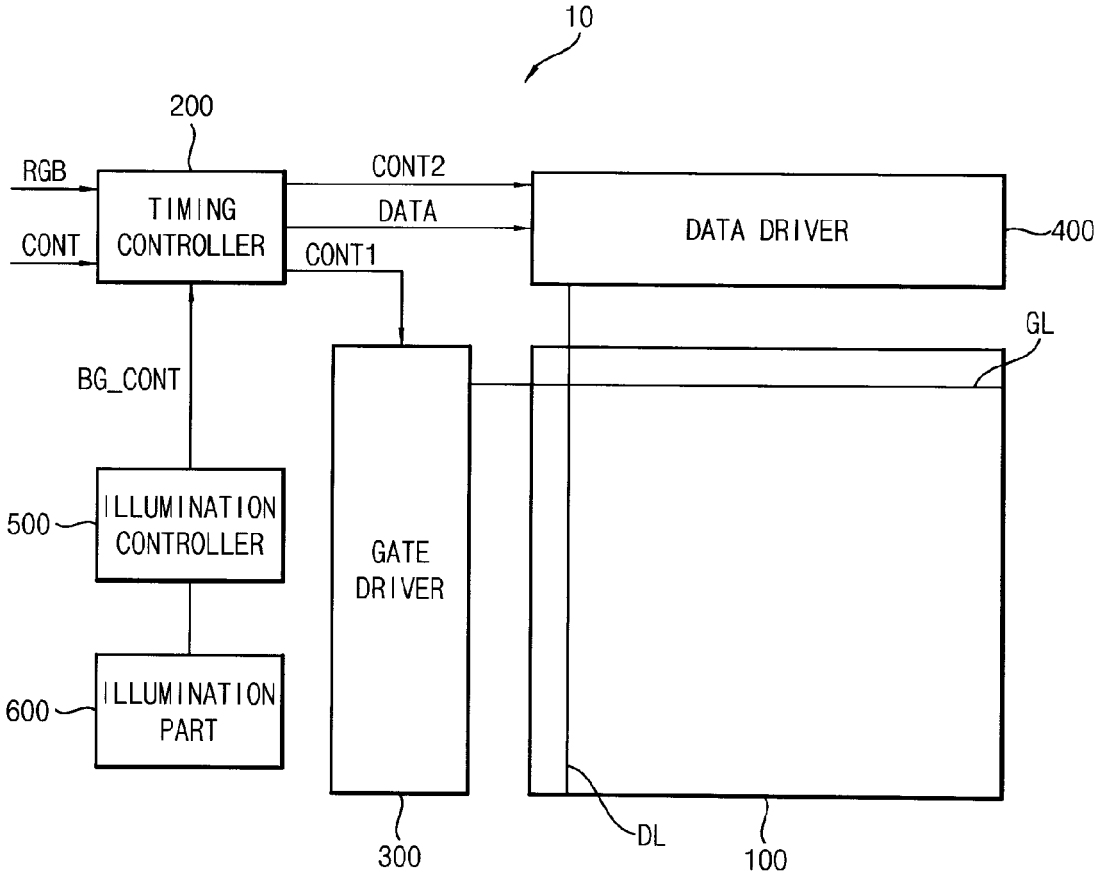
FIG. 2 is a block diagram illustrating the display apparatus in FIG. 1.

FIG. 1 is a perspective view illustrating an exemplary embodiment of a display apparatus in accordance with the invention. FIG. 2 is a block diagram illustrating the display apparatus in FIG. 1.

Referring to FIGS. 1 and 2, an exemplary embodiment of the display apparatus 10 includes a display panel 100, a timing controller 200, a gate driver 300, a data driver 400, an illumination controller 500 and an illumination part 600.

The display panel 100 displays an image in a first direction D1 of the display apparatus 10. The display panel 100 is exposed in a first surface of the display apparatus 10 in the first direction D1. The display panel 100 includes a plurality of gate lines GL, a plurality of data lines DL, and a plurality of unit pixels connected to the gate lines GL and the data lines DL.

Each unit pixel includes a switching element, a liquid crystal capacitor electrically connected to the switching element and a storage capacitor. The unit pixels are disposed substantially in a matrix form.

The illumination part 600 may emit illumination light having a first color in a second direction D2. The second direction D2 is opposite to the first direction D1. The illumination part 600 may include a light source which is configured to generate and emit the illumination light. The light source may include at least one of a light bulb, a fluorescent lamp and a light emitting diode ("LED")

The illumination part 600 may be disposed on in the display apparatus 10. The illumination part 600 may be disposed on a second surface 800 of the display apparatus 10. The second surface 800 may be opposite to the first surface. The second surface 800 may be a surface of a rear case which covers a driver part including the display panel 100, the timing controller 200, the gate driver 300, the data driver 400 and the illumination controller 500. The illumination part 600 may include a plurality of light sources including a first light source 611, a second light source 612, a third light source 613 and a fourth light source 614. In an exemplary embodiment, as shown in FIG. 1, The first to fourth light sources 611 to 614 may be disposed on four corners of the second surface 800, respectively. Alternatively, the illumination part 600 may include a plurality of light sources which are sequentially arranged in a third direction edge and a fourth direction edge. Here, the third direction edge is an edge or side portion of the second surface which is in a third direction D3 perpendicular to the first direction D1 and the fourth direction edge is an edge or side portion of the second surface which is in a fourth direction opposite to the third direction D3.

The illumination controller 500 may be configured to control operation of the illumination part 600 and output an illumination signal BG_CONT corresponding to an intensity of the illumination light. In one exemplary embodiment, for example, the illumination part outputs the illumination signal BG_CONT based on the number of the light sources that are turned on, that is, the light sources in a turn-on state. Alternatively, the illumination part outputs the illumination signal BG_CONT based on a voltage applied to the illumination part 600 to turn on the light sources.

The timing controller 200 receives input image data RGB and an input control signal CONT from an external apparatus and the illumination signal BG_CONT from the illumination controller 500. The input image data RGB may include red image data, green image data and blue image data. The input control signal CONT may include a master clock signal, a data enable signal, a vertical synchronizing signal and a horizontal synchronizing signal.

The timing controller 200 generates a first control signal CONT1, a second control signal CONT2 and a data signal DATA based on the input image data RGB, the input control signal CONT and the illumination signal BG_CONT.

The timing controller 200 generates the first control signal CONT1 to control a driving timing of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 to control a driving timing of the data driver 400 based on the input control signal CONT, and outputs the second control signal CONT2 to the data driver 400. The second control signal CONT2 may include a horizontal start signal and a load signal.

The timing controller 200 generates the data signal DATA based on the input image data RGB and the illumination signal BG_CONT, and outputs the data signal DATA to the data driver 400.

The gate driver 300 receives the first control signal CONT1 from the timing controller 200. The gate driver 300 generates gate signals for driving the gate lines GL in response to the first control signal CONT. The gate driver 300 sequentially outputs the gate signals to the gate lines GL.

In an exemplary embodiment, the display apparatus 10 may further include a gamma reference voltage generator (not shown) which generates a gamma reference voltage. The gamma reference voltage generator provides the gamma reference voltage to the data driver 400. The gamma reference voltages have values corresponding to the data signal DATA. In an exemplary embodiment, the gamma reference voltage generator may be disposed in the data driver 400.

The data driver 400 receives the second control signal CONT2 and the data signal DATA from the timing controller 200. In an exemplary embodiment, the data driver 400 may receive the gamma reference voltage from the gamma reference voltage generator.

The data driver 400 converts the data signal DATA into data voltages of analog type using the gamma reference voltage. The data driver 400 outputs the data voltages to the data lines DL.

The display apparatus may further include a bezel 900 which covers outer edges of the display panel 100. The bezel 900 may include a transparent material, such that a space between an area in which the image displayed and the illumination light decreased.

Figure 3:
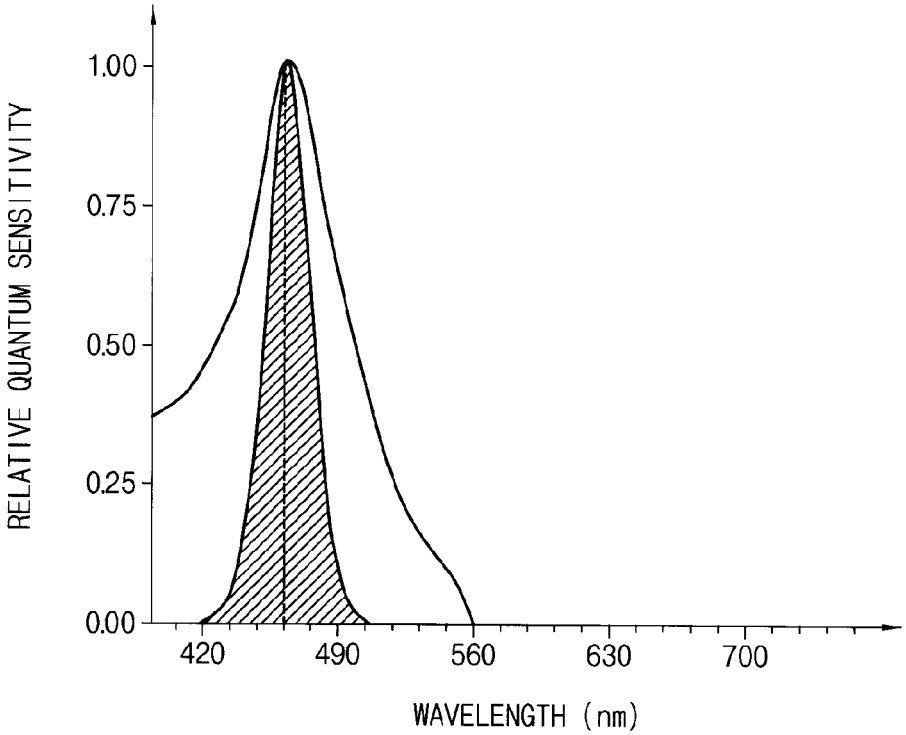
FIG. 3 is a graph showing a wavelength range in which melatonin suppressed.

FIG. 3 is a graph showing a wavelength range in which melatonin suppressed.

A serotonin is produced in the human body during day time, and converted to a melatonin during night time. The melatonin induces sleep. Watching a blue colored light in a wavelength range of about 420 nanometers (nm) to about 500 nm for a long time, the melatonin production is suppressed. Thus, sleep induction is disturbed.

Referring to FIG. 3, inhibitory effect of the melatonin has a maximum effect at about 464 nm, which is a central wavelength of a blue light. The inhibitory effect of the melatonin in a range of about 400 nm to about 500 nm has a weaker effect at suppressing melatonin as being away from the about 464 nm, and not effective at a wavelength greater than about 550 nm.

Figure 4:
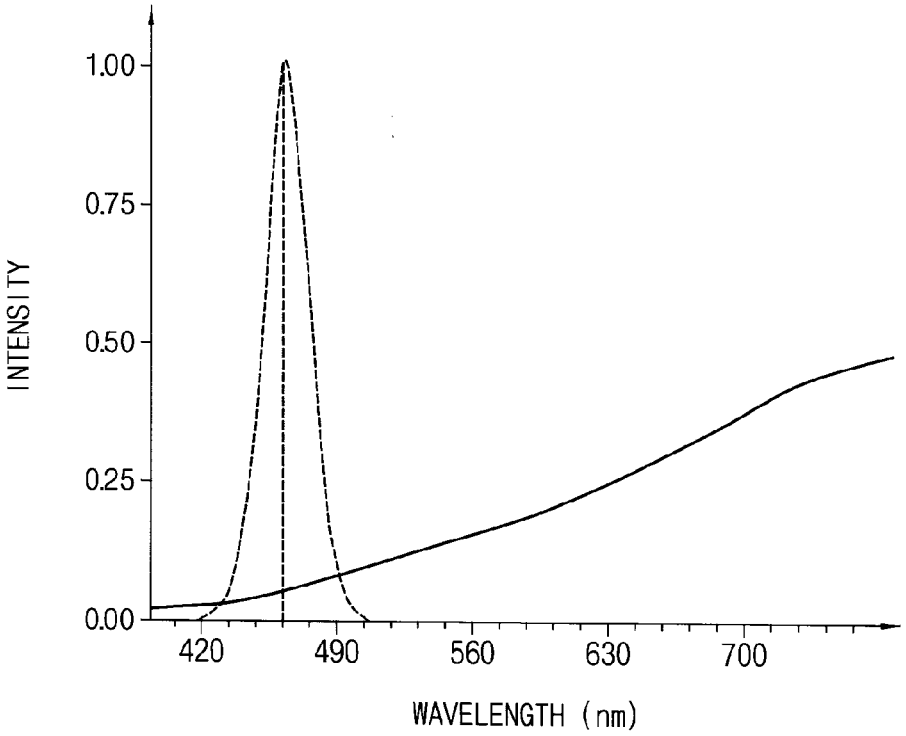
FIG. 4 is a graph showing a first color.
Figure 5:
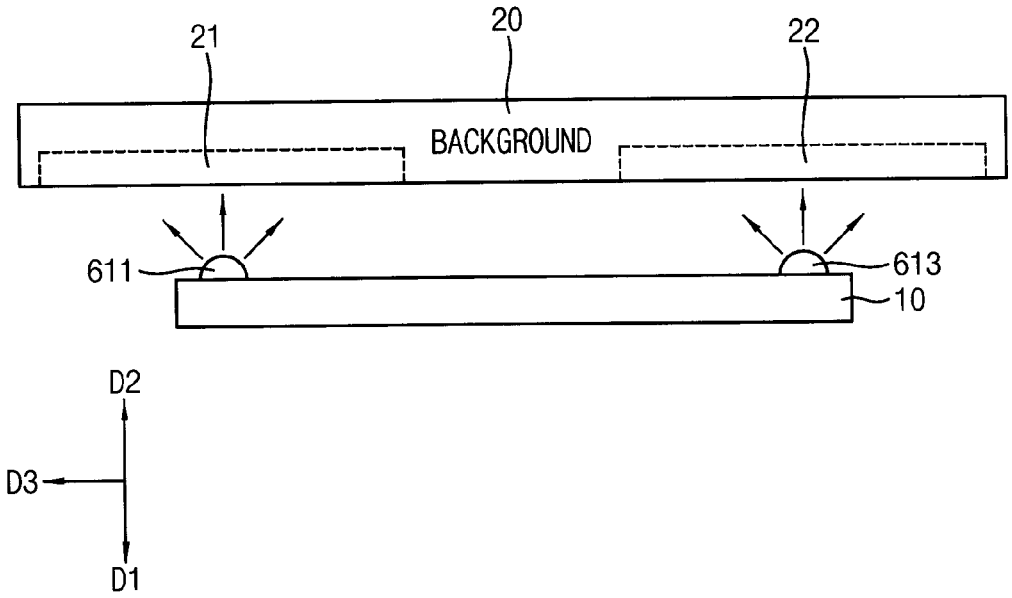
FIG. 5 is a plan view illustrating an exemplary embodiment of a display apparatus which emits illumination light to the background.

FIG. 4 is a graph showing a first color. FIG. 5 is a plan view illustrating an exemplary embodiment of a display apparatus that emits illumination light to the background.

Referring to FIGS. 1, 2, 4 and 5, the illumination light emitted by the illumination part 600 may have a greater intensity in a wavelength range of about 500 nm to about 800 nm than in a wavelength range of about 380 nm to about 500 nm. The intensity of the illumination light may increase in the wavelength range of about 500 nm to about 800 nm, as the wavelength of the illumination light increases. In one exemplary embodiment, for example, the illumination light having the first color may be a yellowish color light.

The illumination part 600 may emit the illumination light to a background 20, from which the display apparatus 10 may be disposed spaced apart in the second direction D2. In one exemplary embodiment, for example, the first light source 611 and the second light source 612 may emit the illumination light to a first portion 21 of the background 20, and the third light source 613 and the fourth light source 614 may emit the illumination light to a second portion 22 of the background 20. Thus, a background color of the display apparatus 10 may be changed substantially to the first color.

Humans may be affected by a chromatic adaptation phenomenon when realize a color of an object. Thus, humans may realize a color of a central object differently when a background color of the central object changed. In one exemplary embodiment, for example, when the illumination part 600 emits the illumination light, a blue color component of the image which is displayed in the display area may be recognized stronger than when the illumination part 600 doesn't emit the illumination light. Accordingly, an image recognized through the display area when the illumination part 600 emits the illumination light and luminance of the blue image data are decreased, may be similar to an image recognized through the display area when the illumination part 600 doesn't emit the illumination light and the luminance of the blue image data are not decreased.

Figure 6:
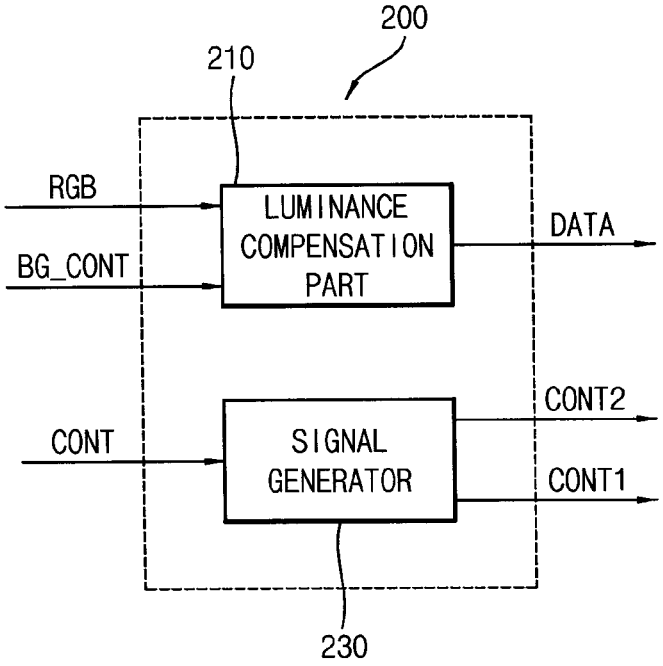
FIG. 6 is a block diagram illustrating an exemplary embodiment of a timing controller in FIG. 2.

FIG. 6 is a block diagram illustrating an exemplary embodiment of a timing controller in FIG. 2.

Referring to FIGS. 2 and 6, the timing controller 200 may include a luminance compensation part 210 and a signal generator 230.

The timing controller 200 receives the input image data RGB and the input control signal CONT from the external apparatus and the illumination signal BG_CONT from the illumination controller 500.

The signal generator 230 may generate the first control signal CONT1 and the second control signal CONT2 based on the input control signal CONT.

The luminance compensation part 210 may generate the data signal DATA based on the input image data RGB and the illumination signal BG_CONT. The luminance compensation part 210 may compensate the luminance of the input image data RGB based on the illumination signal BG_CONT to output the data signal DATA.

In an exemplary embodiment, the luminance compensation part 210 may decrease the luminance of the blue image data based on the illumination signal BG_CONT. The luminance compensation part 210 may decrease a grayscale level of the blue image data. A luminance decrease rate (e.g., the decreased amount of the grayscale level) of the blue image data may increase, as a value of the illumination signal BG_CONT increases.

In one exemplary embodiment, for example, when the illumination signal BG_CONT has a value corresponding to the number of the light sources in a turn-on state, the luminance decrease rate of the blue image data may increase, as the number of the light sources increases. The luminance decrease rate of the blue image data may have predetermined data by experiment.

Alternately, when the illumination signal BG_CONT has a value corresponding to a voltage level of a voltage supplied to the illumination part 600 to turn on the light sources, the luminance decrease rate of the blue image data may increase, as the intensity of the voltage increases. The luminance decrease rate of the blue image data may have predetermined data by experiment.

In such an embodiment, the luminance compensation part 210 may include a look-up table. The look-up table may include a first look-up table which has the luminance decrease rate of the blue image data corresponding to the illumination signal BG_CONT. In one exemplary embodiment, for example, the first look-up table may have values corresponding to the illumination signal BG_CONT and values corresponding to the luminance decrease rate of the blue image data.

In another exemplary embodiment, the luminance compensation part 210 may compensate the luminance of the blue image data, luminance of the green image data and luminance of the red image data based on the illumination signal BG_CONT. In one exemplary embodiment, for example, the luminance compensation part 210 may decrease the luminance of the blue image data and the luminance of the green image data, and may increase the luminance of the red image data based on the illumination signal BG_CONT. The luminance compensation part 210 may decrease the grayscale level of the blue image data and a grayscale level of the green image data, and may increase a grayscale level of the red image data. The luminance decrease rate of the blue image data, a luminance decrease rate of the green image data and a luminance increase rate of the red image data may increase, as a value of the illumination signal BG_CONT increases.

In one exemplary embodiment, for example, when the illumination signal BG_CONT has a value corresponding to the number of the light sources in a turn-on state, the luminance decrease rates of the blue image data and the green image data, and the luminance increase rate of the red image data may increase, as the number of the light sources increases. Luminance variation rates of the blue image data, the green image data and the red image data may have predetermined data by experiment.

Alternately, when the illumination signal BG_CONT has a value corresponding to the intensity of the voltage supplied to the illumination part 600 to turn on the light sources, the luminance decrease rates of the blue image data and the green image data, and the luminance increase rate of the red image data may increase, as the intensity of the voltage increases. The luminance variation rates of the blue image data, the green image data and the red image data may have predetermined data by experiment.

In such an embodiment, the look-up table may further include a second look-up table and a third look-up table. The second look-up table may have values of the luminance decrease rate of the green image data corresponding to the illumination signal BG_CONT. The third look-up table may have values of the luminance increase rate of the red image data corresponding to the illumination signal BG_CONT. In one exemplary embodiment, for example, the second look-up table may have values corresponding to the illumination signal BG_CONT and values corresponding to the luminance decrease rate of the green image data. And the third look-up table may have values corresponding to the illumination signal BG_CONT and values corresponding to the luminance increase rate of the red image data. Alternatively, the first, second and third look-up tables may be formed in a single look-up table.

In another exemplary embodiment, the luminance compensation part 210 may compensate the luminance of the blue image data, the luminance of the green image data and the luminance of the red image data based on the illumination signal BG_CONT and the grayscale level. In one exemplary embodiment, for example, the luminance compensation part 210 may decrease the luminance of the blue image data and the luminance of the green image data, and may increase the luminance of the red image data based on the illumination signal BG_CONT and grayscale levels of the blue, green and red image data. In such an embodiment, the luminance compensation part 210 may decrease the grayscale level of the blue image data and the grayscale level of the green image data, and may increase the grayscale level of the red image data based on the illumination signal BG_CONT.

In one exemplary embodiment, for example, the input image data RGB may have the grayscale level of the blue, green and red image data of the each pixel. In one exemplary embodiment, for example, the grayscale level may have total N levels, and the grayscale level may be divided into M reference grayscale levels. Here, N and M are natural numbers. N may be greater than M. Thus, even if the illumination signals BG_CONT have a same value, the luminance decrease rates of the blue image data may vary as the grayscale levels of the blue image data may be based on different reference grayscale levels. Thus, even if the illumination signals BG_CONT have a same value, the luminance decrease rates of the green image data may vary as the grayscale levels of the green image data may be based on different reference grayscale levels. Thus, even if the illumination signals BG_CONT have a same value, the luminance increase rates of the red image data may vary as the grayscale levels of the red image data may be based on different reference grayscale levels.

In such an embodiment, the luminance variation rates of the blue image data, the green image data and the red image data may have predetermined data by experiment.

In such an embodiment, the look-up table may include a fourth look-up table. The fourth look-up table may have the M reference grayscale levels and the M grayscale levels. And each of the M reference grayscale levels may correspond to sub look-up tables having values of the luminance decrease rates of the blue image data and the green image data, and values of the luminance increase rate of the red image data correspond to values of the illumination signal BG_CONT, respectively.

Figure 7:
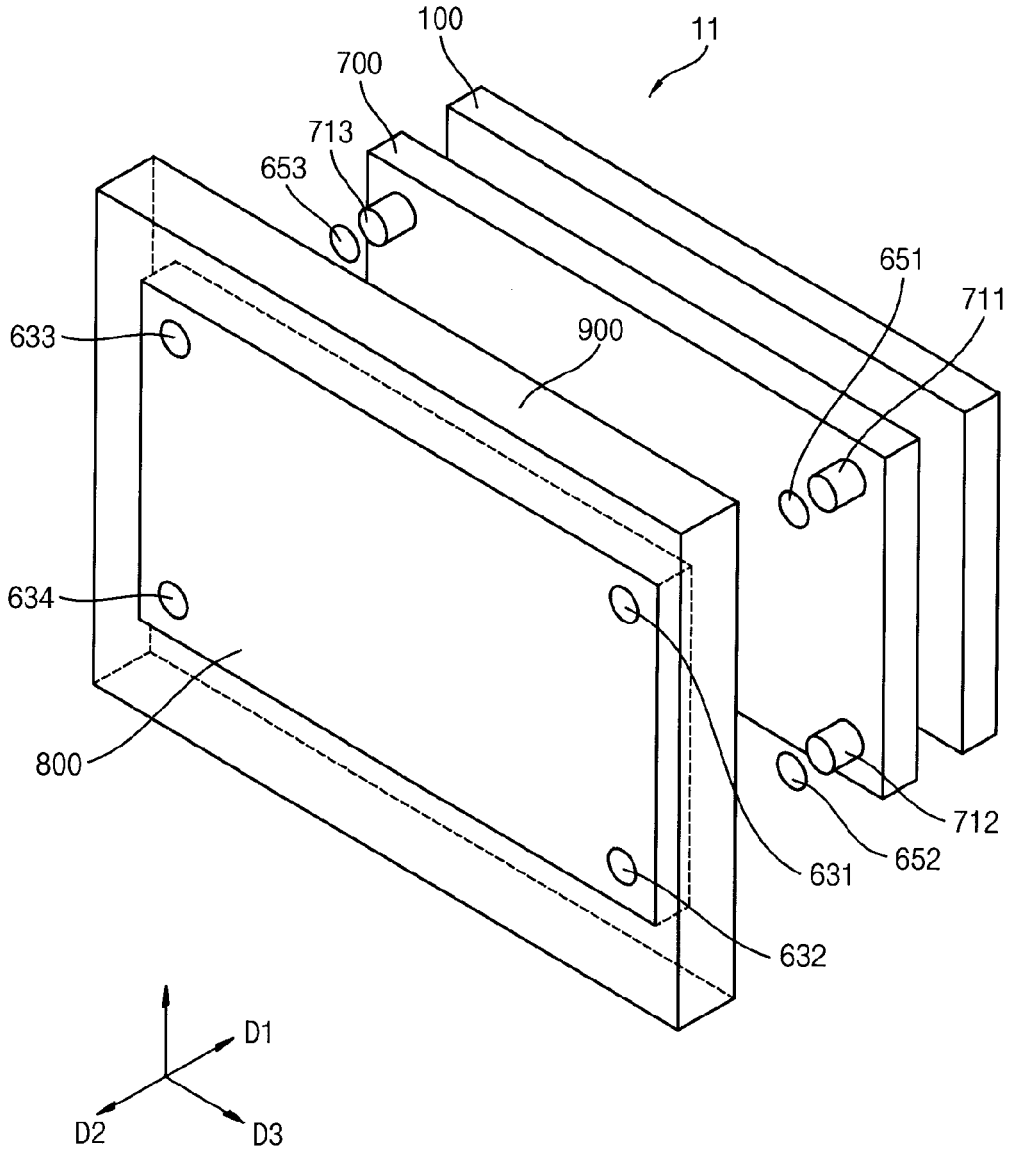
FIG. 7 is an exploded perspective view illustrating another exemplary embodiment of a display apparatus in accordance with the invention.
Figure 8:
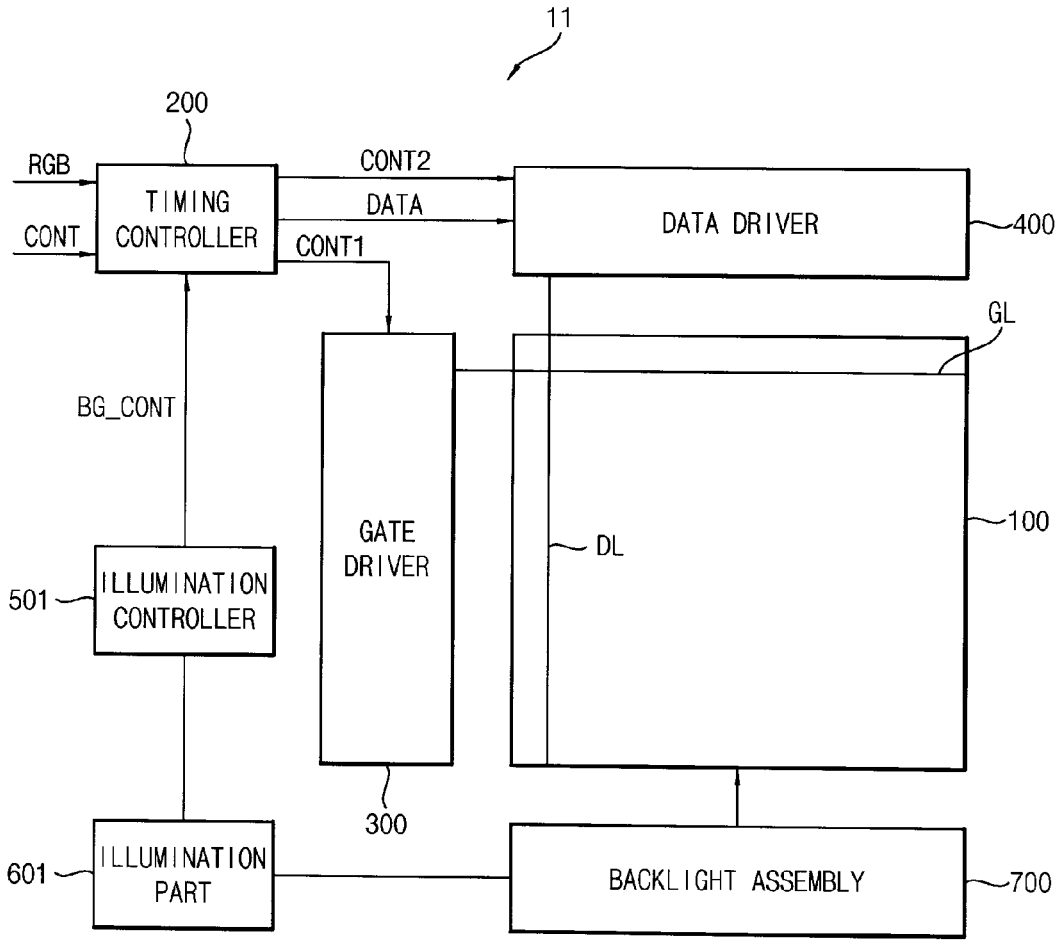
FIG. 8 is a block diagram illustrating the display apparatus in FIG. 7.

FIG. 7 is an exploded perspective view illustrating another exemplary embodiment of a display apparatus in accordance with the invention. FIG. 8 is a block diagram illustrating the display apparatus in FIG. 7.

The display apparatus 11 shown in FIGS. 7 and 8 is substantially the same as the display apparatus in FIGS. 1, 2, 4 and 6 except for an illumination controller 501, an illumination part 601 and a backlight assembly 700. Thus, the same reference numerals will be used to refer to same or like elements as those described in with reference to FIGS. 1, 2, 4 and 6, and any detailed repetitive description thereof will be omitted.

Referring to FIGS. 1 and 8, an exemplary embodiment of the display apparatus 11 includes a display panel 100, a timing controller 200, a gate driver 300, a data driver 400, the illumination controller 501, the illumination part 601 and the backlight assembly 700.

The backlight assembly 700 may provide light to the display panel 100. In one exemplary embodiment, for example, the backlight assembly 700 may include a plurality of light emitting diodes.

In an exemplary embodiment, the backlight assembly 700 may be a direct type backlight assembly that is disposed under the display panel 100 to provide light to the display panel 100. In an alternative exemplary embodiment, the backlight assembly 700 may be an edge type backlight assembly that is disposed corresponding to a side portion of the display panel 100 to provide light to the display panel 100.

In an exemplary embodiment, the backlight assembly 700 may be a global dimming type backlight assembly, in which a plurality of backlight sources is commonly controlled. Alternatively, the backlight assembly 700 may be a local dimming type backlight assembly, which includes a plurality of backlight source blocks that may be driven independently of each other.

The illumination part 601 may be disposed in a second surface 800. The second surface 800 may be a surface of a rear case which covers a driver part including the display panel 100, the timing controller 200, the gate driver 300, the data driver 400 and the illumination controller 501.

The illumination part 601 may emit illumination light having a first color in the second direction D2.

The illumination part 601 may include a light emitting part which is configured to emit the illumination light.

The illumination part 601 may include a first light emitting part 631, a second light emitting part 632, a third light emitting part 633 and a fourth light emitting part 634. Each of the first to fourth light emitting part 631 to 634 is disposed on four corners of the second surface 800, respectively. Alternatively, the illumination part 601 may include a plurality of light emitting part which is sequentially arranged in a third direction edge and a fourth direction edge. The third direction edge is an edge or side portion of the second surface which is in the third direction D3 perpendicular to the first direction D1 and the fourth direction edge is an edge or side portion of the second surface which is in the fourth direction opposite to the third direction D3.

In an exemplary embodiment, the illumination part 601 may use the light emitted by the backlight assembly 700 to emit the illumination light. Accordingly, the backlight assembly 700 may further include a light guide part which is configured to guide the light to the light source. For example, the light guide part may include a first light guide part 711, a second light guide part 712, a third light guide part 713 and a fourth light guide part. The first light guide part 711 may guide the light emitted by the backlight assembly 700 to the first light emitting part 631. The second light guide part 712 may guide the light emitted by the backlight assembly 700 to the first light emitting part 632. The third light guide part 713 may guide the light emitted by the backlight assembly 700 to the third light emitting part 633. The fourth light guide part may guide the light emitted by the backlight assembly 700 to the fourth light emitting part 634.

In an exemplary embodiment, the illumination part 601 may further include an optical film which is configured to convert the light emitted by the backlight assembly 700 into the illumination light. In one exemplary embodiment, for example, the illumination part 601 may further include a first optical film 651, a second optical film 652, a third optical film 653 and a fourth optical film.

In such an embodiment, the first optical film 651 may convert the light emitted by the backlight assembly 700 to the illumination light, and may be disposed between the first light emitting part 631 and the first light guide part 711. The second optical film 652 may convert the light emitted by the backlight assembly 700 to the illumination light, and may be disposed between the second light emitting part 632 and the second light guide part 712. The third optical film 653 may convert the light emitted by the backlight assembly 700 to the illumination light, and may be disposed between the third light emitting part 633 and the third light guide part 713. The fourth optical film may convert the light emitted by the backlight assembly 700 to the illumination light, and may be disposed between the fourth light emitting part 634 and the fourth light guide part 714.

The illumination controller 501 may be configured to control operation of the illumination part 601 and output an illumination signal BG_CONT corresponding to an intensity of the light emitted by the backlight assembly 700. In one exemplary embodiment, for example, the illumination part outputs the illumination signal BG_CONT based on a voltage which is applied to the backlight assembly 700.

According to one or more exemplary embodiments of the invention, as set forth herein, the display apparatus emits illumination light having a yellowish color into external background of the display apparatus. Thus, the display apparatus may display an image having blue light which has a relatively lower luminance than a luminance before the illumination light emitted. When the image has the blue light having the relatively lower luminance, effects of melatonin suppression decreases, and power consumption decreases by using the blue light having the relatively lower luminance.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel comprising data lines, and configured to display an image in a first direction;

an illumination part configured to emit illumination light having a first color in a second direction opposite to the first direction;

an illumination controller configured to control the illumination part and output an illumination signal corresponding directly to an intensity of the illumination light emitted from the illumination part;

a luminance compensation part configured to compensate luminance of an input image data based on the illumination signal to output a data signal; and a data driver configured to generate a data voltage based on the data signal, and output the data voltage to the data lines, wherein the luminance compensation part decreases luminance of one color of the image data of a plurality of colors of the image data based on the illumination signal, and the illumination signal is based only on a number of light sources of the illumination part that are in a turn-on state or based directly on the voltage provided to the illumination part.

2. The display apparatus of claim 1, wherein the input image data comprises red image data, green image data and blue image data, and the luminance compensation part decreases luminance of the blue image data based on the illumination signal.

3. The display apparatus of claim 2, wherein the luminance compensation part comprises a first look-up table comprising values of a luminance decrease rate of the blue image data corresponding to the illumination signal.

4. The display apparatus of claim 1, wherein the input image data comprises red image data, green image data and blue image data, and the luminance compensation part decreases luminance of the blue image data and the green image data, and increases luminance of the red image data, based on the illumination signal.

5. The display apparatus of claim 4, wherein the luminance compensation part comprises:

a first look-up table comprising values of a luminance decrease rate of the blue image data corresponding to the illumination signal;

a second look-up table comprising values of a luminance decrease rate of the green image data corresponding to the illumination signal; and a third look-up table comprising values of a luminance increase rate of the red image data corresponding to the illumination signal.

6. The display apparatus of claim 4, wherein a luminance decrease rate of the blue image data corresponds to a grayscale level of the blue image data, a luminance decrease rate of the green image data corresponds to a grayscale level of the green image data, and a luminance increase rate of the red image data corresponds to a grayscale level of the red image data.

7. The display apparatus of claim 1, wherein the intensity of the illumination light in a wavelength range of about 500 nanometers to about 800 nanometers is greater than the intensity of the illumination light in a wavelength range of about 380 nanometers to about 500 nanometers.

8. The display apparatus of claim 7, wherein the intensity of the illumination light at a wavelength in the wavelength range of about 500 nanometers to about 800 nanometers increases, as the wavelength increases.

9. The display apparatus of claim 1, wherein the illumination part comprises a plurality of light sources configured to generate the illumination light, and the illumination controller outputs the illumination signal based on how many of the light sources are in a turn-on state.

10. The display apparatus of claim 1, further comprising:

a backlight assembly which is configured to provide light to the display panel, wherein the illumination part emits the illumination light using the light emitted by the backlight assembly, and the illumination signal corresponds to an intensity of the light emitted by the backlight assembly.

11. The display apparatus of claim 10, further comprising:

a light guide part which is configured to guide the light emitted by the backlight assembly to the illumination part, wherein the illumination part comprises an optical film which is configured to convert the light emitted by the backlight assembly into the illumination light.

12. The display apparatus of claim 1, further comprising:

a bezel which covers outer edges of the display panel, wherein the bezel comprises a transparent material.

13. A method of displaying an image using a display apparatus, the method comprising:

emitting illumination light having a first color from a second surface of the display apparatus to an external background, wherein the second surface is opposite to a first surface of the display apparatus on which the image is displayed;

outputting an illumination signal corresponding directly to an intensity of the illumination light emitted from the second surface of the display apparatus; and compensating luminance of an input image data, which comprises decreasing luminance of one color of the image data of a plurality of colors of the image data based on the illumination signal, wherein the illumination signal is based only on a number of light sources of the illumination part that are in a turn-on state or based directly on the voltage provided to the illumination part.

14. The method of claim 13, wherein the input image data comprises red image data, green image data and blue image data, and the compensating the luminance of the input image data comprises decreasing luminance of the blue image data based on the illumination signal.

15. The method of claim 14, wherein the intensity of the illumination light in a wavelength range of about 500 nanometers to about 800 nanometers is greater than the intensity of the illumination light in a wavelength range of about 380 nanometers to about 500 nanometers, and the intensity of the illumination light at a wavelength in the wavelength range of about 500 nanometers to about 800 nanometers increases, as the wavelength increases.

16. The method of claim 14, wherein the compensating the luminance of the input image data comprises:

decreasing luminance of the green image data based on the illumination signal, and increasing luminance of the red image data based on the illumination signal.

17. The method of claim 13, wherein the emitting the illumination light having the first color comprises using an illumination part, wherein the illumination part comprises a light source configured to generate the illumination light.

18. The method of claim 13, wherein the emitting the illumination light having the first color comprises using an illumination part, which emits the illumination light using light emitted by a backlight assembly of the display apparatus, wherein the backlight assembly is configured to provide the light to a display panel.

* * * * *